US007506859B2

(12) United States Patent
Keller et al.

(10) Patent No.: US 7,506,859 B2
(45) Date of Patent: Mar. 24, 2009

(54) POST RETENTION ANCHOR

(76) Inventors: William R. Keller, 104 S. Academy Dr., Ephrata, PA (US) 17522; John Makuvek, P.O. Box 517, Kresgeville, PA (US) 18333

( * ) Notice: Subject to any disclaimer, the term of this patent is extended or adjusted under 35 U.S.C. 154(b) by 114 days.

(21) Appl. No.: 11/251,036

(22) Filed: Oct. 14, 2005

(65) Prior Publication Data

US 2006/0186392 A1 Aug. 24, 2006

Related U.S. Application Data

(60) Provisional application No. 60/654,308, filed on Feb. 18, 2005.

(51) Int. Cl.
*E04H 17/22* (2006.01)

(52) U.S. Cl. ..... 256/65.14; 256/1; 256/19; 52/165; 52/169.13

(58) Field of Classification Search ..... 52/169.13, 52/165, 736.4; 256/1, 19, 65.14
See application file for complete search history.

(56) References Cited

U.S. PATENT DOCUMENTS 574,191 A * 12/1896 Clayton ..... 52/165
905,794 A * 12/1908 Crego ..... 52/742.14
1,419,108 A * 6/1922 Bitting ..... 52/168
1,553,785 A * 9/1925 Ley ..... 52/297
2,109,508 A * 3/1938 Schmittutz ..... 52/736.4
3,776,522 A * 12/1973 Bartlett ..... 256/19
4,516,365 A * 5/1985 Chapman ..... 52/741.14
4,543,757 A 10/1985 Cosgrove
5,138,806 A * 8/1992 Marx et al. ..... 52/170
5,564,232 A 10/1996 Callaway
6,018,917 A 2/2000 Leek
6,041,559 A 3/2000 Schickert et al.
6,098,351 A * 8/2000 Mills ..... 52/736.4
6,343,446 B1 * 2/2002 Beard ..... 52/165
6,389,760 B1 5/2002 McDonnell
6,560,935 B1 5/2003 Barefield
6,886,296 B1 * 5/2005 John et al. ..... 52/169.13

* cited by examiner

*Primary Examiner*—Michael P Ferguson
(74) *Attorney, Agent, or Firm*—Andrew D. Mead

(57) ABSTRACT

An improved anchor for degradation-resistant treated posts or posts protected with a conforming, protective cover that resists uplift or pull-out forces of a predetermined value without compromising the integrity of the treatment or protective cover. At least one indentation is applied to a portion of the post embedded in the ground prior to applying a conforming, protective cover or the other material degradation-resistant treatment. The indentation is configured such that the protective cover will conform to the contour of the indentation when the protective cover is applied to the post. In posts relying on degradation-resistant treatments, the indentation is applied prior to treatment so that the integrity of the treatment is not compromised by the indentation.

2 Claims, 5 Drawing Sheets

POST RETENTION ANCHOR

CROSS-REFERENCE TO RELATED APPLICATIONS

This application claims the benefit of U.S. Provisional Application 60/654,308, filed Feb. 18, 2005.

BACKGROUND OF THE INVENTION

This invention deals generally with anchoring means for building columns that are embedded in the earth. Specifically, this invention relates to a method for anchoring vertical wooden posts that are used in the construction of post-frame buildings so the posts resist uplift forces imposed on the structural members without degrading protective materials used on the embedded portion of the post.

Post-frame buildings originated from pole barns and are today used for a wide variety of agricultural, commercial, and industrial purposes since they are, compared to many other types of construction, relatively simple and inexpensive to erect. Conventional post-frame buildings use vertical load bearing wooden posts having their lower ends buried in the earth and their upper ends integrated into the building frame. Suitable footing for the wooden poles is necessary to withstand downward forces from the weight of the building. A typical footing consists of a cylindrical hole approximately 4 feet deep with a concrete base pad in the bottom of the hole on which the post is positioned. At one time, holes were backfilled with compacted earth to maintain the post vertically plumb while the building frame was constructed and also to provide a stable foundation for the completed building. However, increasing building demands on foundations now typically require concrete backfill to provide sufficient foundation strength.

Two problems facing post-frame construction are 1) deterioration of the embedded portion of wooden posts, especially at the interface between the post and the ground surface, and 2) the need to provide a more secure anchorage for the post. The former problem may be addressed through the use of preservative-treated wooden posts to repel insects and decay. However, concrete is known to neutralize many wood-preservative chemicals, promote wood decay, and weaken the structural integrity of wood. An increasingly popular solution in light of costs, environmental risks, and limitations of wood post chemical treatment is the application of protective covers or other water-impermeable media to the embedded portion of the post. U.S. Pat. No. 5,891,583 shows one such protective sleeve. A key consideration in the effectiveness of both preservative treatment and protective sleeves is that care must be taken to avoid breaching the protective barrier as such breaches can lead to premature deterioration of the wood.

Providing sufficient anchorage for the post is becoming increasingly important as post-frame buildings are subjected to safer, more stringent building requirements. One such design consideration is the capability of buildings to resist uplift forces caused by wind loading on the building in which the uplift loads can be on the order of 2,400 pounds per post using 6×6 inch posts. A variety of methods may be used to enhance the foundation capability of embedded posts in response to this requirement. Protrusions may be affixed to the embedded portion of the post exterior surface that extend into the backfill area, thereby increasing the post's ability to withstand pull-out forces. Perhaps the simplest means of adding a protrusion is to bore one or more horizontal holes through the post and to insert a steel bar through the hole. Alternatively, wooden or metallic protrusions can be attached to the external surface of the post using screws, nails, or other fastening hardware. U.S. Pat. No. 6,389,760 discloses a protective sleeve into which the embedded portion of a wooden post is inserted. Protrusions in the form of ridges are molded onto the external surface of the sleeve. These ridges extend into the backfill and provide increased resistance to forces along the post's longitudinal axis.

One shortcoming resulting from use of attached protrusions is the need to breach the wood's external surface or applied protective cover, whether with a hole bored through the post or nails or screws projecting into the post. Preservative treatments are most effective near the external surface of the wooden post. Protection of the interior portions of the post may be less than at the wood surface depending on the effectiveness of the treatment process. Boring a hole thorough the post or using a lag bolt to attach an anchoring device introduces a path for moisture to reach relatively unprotected portions of the wood, which leads to deterioration of the less protected wood. In cases when protective sleeves are employed, any perforation of the protective layer creates a pathway for moisture to reach the wooden post and lead to post deterioration, an especially important consideration since protective sleeves are typically used in lieu of preservative treatment of the wood. Despite the known problems with perforations in protective covers, U.S. Pat. No. 6,389,760 employs one or more lag screws to secure the protective sleeve to the wooden post. The point at which the lag screw penetrates the sleeve is sealed with a neoprene or polyethylene washer to prevent moisture intrusion. In the event that the washer fails, this approach creates a pathway for water intrusion that will ultimately result in premature deterioration of the wooden post.

SUMMARY OF THE INVENTION

The present invention is directed to an improved means to anchor a post used in traditional posts, utility poles, post-frame construction, and the like that provides increased resistance to upward and downward axial forces imposed on the post, without compromising known coating or conforming cover-based post protective measures that may be applied to the embedded portions of the post.

In the preferred embodiment, the post retention anchor comprises a conventional rectangular wooden post having at least one pair of indentations formed into opposing longitudinal corners of the post. The indentations may be formed by milling, cutting, or by any other means. The indentation shape is rounded to avoid stress concentration resulting from sharp-cornered indentations in wooden posts and to provide smooth transitions for the conforming, protective cover. The preferred indentations are formed by milling circular sectors from opposing longitudinal corners of post, with each indentation measuring approximately four inches in length along the corner and approximately three-quarters of an inch in depth, measured from the post corner to the inwardmost point of the indentation. The indentations are formed in the post prior to application of any conforming, protective covers on the portion of the post to be protected or other preservative treatments. When applied, the conforming, protective cover adheres to the contours of the post, including the indentations, and results in an unperforated, protective barrier that conforms to the exterior contours of the post.

Post pull-out resistance may altered by varying the size, shape, location, or number of indentations formed on the post. Indentations are ideally added in pairs on opposing corners of the post. Adjacent pairs are arranged perpendicularly to each other and spaced along the length of the post so that they do not overlap and weaken the post by excessive material removal in the same perimeter plane. This arrangement also allows conforming, protective covers, such as polyethylene heat shrink material, to conform fully to the indentations.

The primary advantage of the invention is that the addition of anchoring indentations, previously unknown in the art, allows the post to better resist applied axial forces, whether upward or downward, and does so without compromising protective sleeves or other measures taken to prevent wood deterioration. Another advantage of the invention is, unlike more conventional anchoring methods, no additional hardware is needed to form the anchor. The anchoring indentations are formed directly into the post.

In other embodiments of the invention, posts having different cross-sectional shapes, such as round posts, are used. The indentation shape and placement on the post may also vary, being rounded or angular, or located symmetrically, asymmetrically, or randomly. The post material may be other than wood, such as metal or composite. Metal posts are more likely be hollow rather than solid, such as a pipe or rectangular structural tube. Indentations into metallic posts are more easily pressed or stamped into the exterior surface instead of cutting, since cutting an indentation into a hollow post would open a hole without providing the indentation surface to serve as the anchor. Indentations into composite posts may be formed during manufacture or afterward depending on the particular composite material.

Other features and advantages of the present invention will become apparent from the detailed description of the preferred embodiment taken in conjunction with the accompanying figures illustrating the features and principles of the invention.

DETAILED DESCRIPTION OF THE INVENTION

When referring to the Figures, like parts are numbered the same in all of the Figures.

Figure 1:
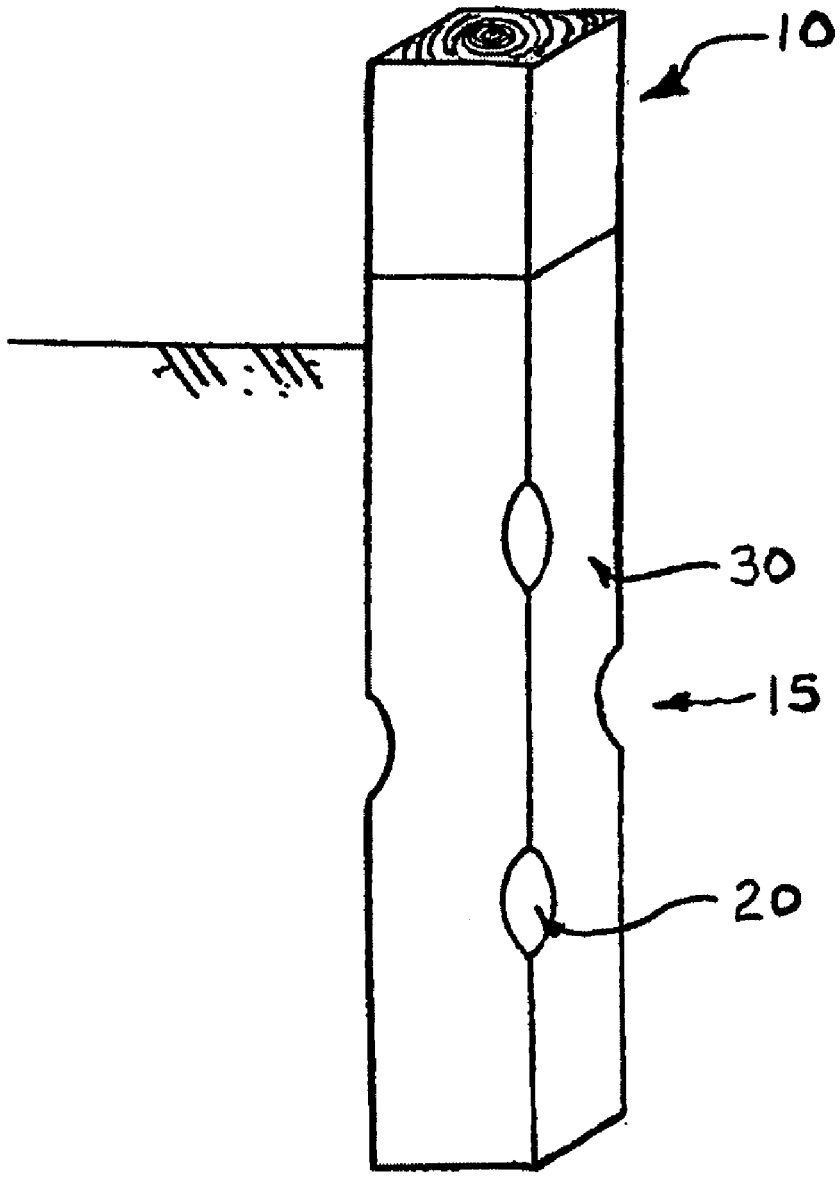
FIG. 1 is a partial perspective view of the embedded end of the preferred embodiment using a typical rectangular post.

FIG. 1 is a perspective partial view of one embodiment of the post retention anchor 15 on a rectangular post. Post 10 is a conventional wooden post used in post-frame building construction. The portion of post 10 shown is that which is typically embedded into the ground to form a building foundation. Also shown in FIG. 1 is indentation 20 and conforming protective cover 30. In the preferred embodiment, the conforming protective cover 30 is as described in U.S. Pat. No. 6,033,519, but the post retention anchor 15 may also be used with other protective coverings that conform to the shape of the post and indentations.

Wooden posts used in post-frame construction typically are sawn, solid 4×6, having finished dimensions of 3½ inches by 5½ inches. Other commonly used sizes are 6×6, having finished dimensions of 5½ inches square; 4×4, having finished dimensions of 3½ inches square; and 6×8, having finished dimensions of 5½ by 7½ inches. Post sizes larger than 6×6 are generally composite posts instead of a single solid piece of wood. Other sizes are not precluded by the invention and may be used in a variety of applications, but post sizes smaller than 4×4 generally do not offer sufficient strength for use as columns in post-frame buildings. Various wood species are used in post-frame construction, with southern pine being common due to its cost, availability, and strength. Typical uplift loads for a 4×6 post are approximately 1,000 pounds; a 6×6 post might be required to withstand as much as 2,400 pounds of uplift without pulling out of the ground.

The primary advantage of the invention is that the addition of anchoring indentations, previously unknown in the art, allows the post to better resist applied axial forces, whether upward or downward, and does so without compromising protective conforming covers, or other similar measures taken to prevent wood deterioration. In the preferred embodiment, the shape and location of anchor indentations on the post define overall exterior contour dimensions for the post that are within the shrink ratio of conventional polyethylene used as a protective cover. Another advantage of the invention is that it is not limited to heat-shrinkable conforming protective covers. Other forms of conforming, protective covers may also be applied to the post once the indentations are formed. In the event a conventional pressure-treated post is used without any type of protective cover on the embedded portion of the post, forming the indentations prior to treating the post provides the increased anchoring capability without compromising the effective of wood preservation measures. Yet another advantage of the invention is, unlike more conventional anchoring methods, no additional hardware is needed to form the anchor; the anchoring indentations are formed directly into the post.

Referring to FIG. 1 showing the preferred embodiment, indentation 20 is formed into a longitudinal corner of post 10. Indentation 20 is shaped such that it intrudes into the post volume to create a recessed area in the exterior surface of the post. Indentation 20 may be formed using a variety of methods, but in the described embodiment, it is shaped by cutting a circular sector into the post corner. One or more rounded indentations applied to the longitudinal corners of the post enable conforming, protective coatings, such as polyethylene heat shrink material, to mimic the contours of the post when applied. The contour of indentation 20 creates a restraining area upon which a restraining pressure may act to create a post restraining force oriented parallel to the longitudinal post axis. A single indentation in a #2 Southern Pine post located a minimum of four inches from the post end and having a depth into the post of ¾ inch can withstand an axially applied uplift force of approximately 1,680 pounds. Two such indentations can provide over 3,000 pounds of uplift capability. In comparison, a ½-inch diameter rebar located in a hole drilled through the post perpendicular to the longitudinal axis provides approximately 1,444 pounds of uplift resistance. Two such anchors are required to meet the typical uplift requirements resulting in two holes bored through the treated post. Nailing a pair of 2×6 blocks to opposing faces of the post end using 6 nails per block yields an uplift capacity of 2,040 pounds. Additional blocks are necessary to meet a 2,400 pound uplift requirement. Nails are subject to corrosion and also penetrate the treated post with the resultant pathway for decay. Neither rebar or wooden block anchors are compatible with know conforming protective post covers.

In many cases, the strength of the anchors exceeds the strength of the fill material, requiring additional anchors. For example, a 6×6 post with a pair of indentations as described above and backfilled with 3,000 psi concrete can withstand only 1,860 pounds of uplift force due to limitations of the concrete. The post anchor itself is not the limiting factor in the overall post anchorage capability. Increasing the pull-out force that the post will withstand may accomplished by increasing the size of the restraining area, such as by increasing the depth of the indentation. Restraining capability may also be increased by increasing the number of indentations formed on the post. Indentations are ideally added in pairs on opposite corners of the post. Adjacent pairs are arranged perpendicularly to each other and spaced along the length of the post so that they do not overlap within the a single perimeter region and weaken the post by excessively reducing the cross-sectional area of the post. This arrangement also allows conforming, protective coatings, such as polyethylene heat shrink material, to fully conform to the indentations. Indentation location along the post's length also influences restraining capability. Increasing the distance from the post end increases the area of the shear plane on which the restraining force is applied, thereby increasing pullout resistance capability. These approaches allow the required pullout resistance to be achieved for a variety of backfill materials.

Figure 2:
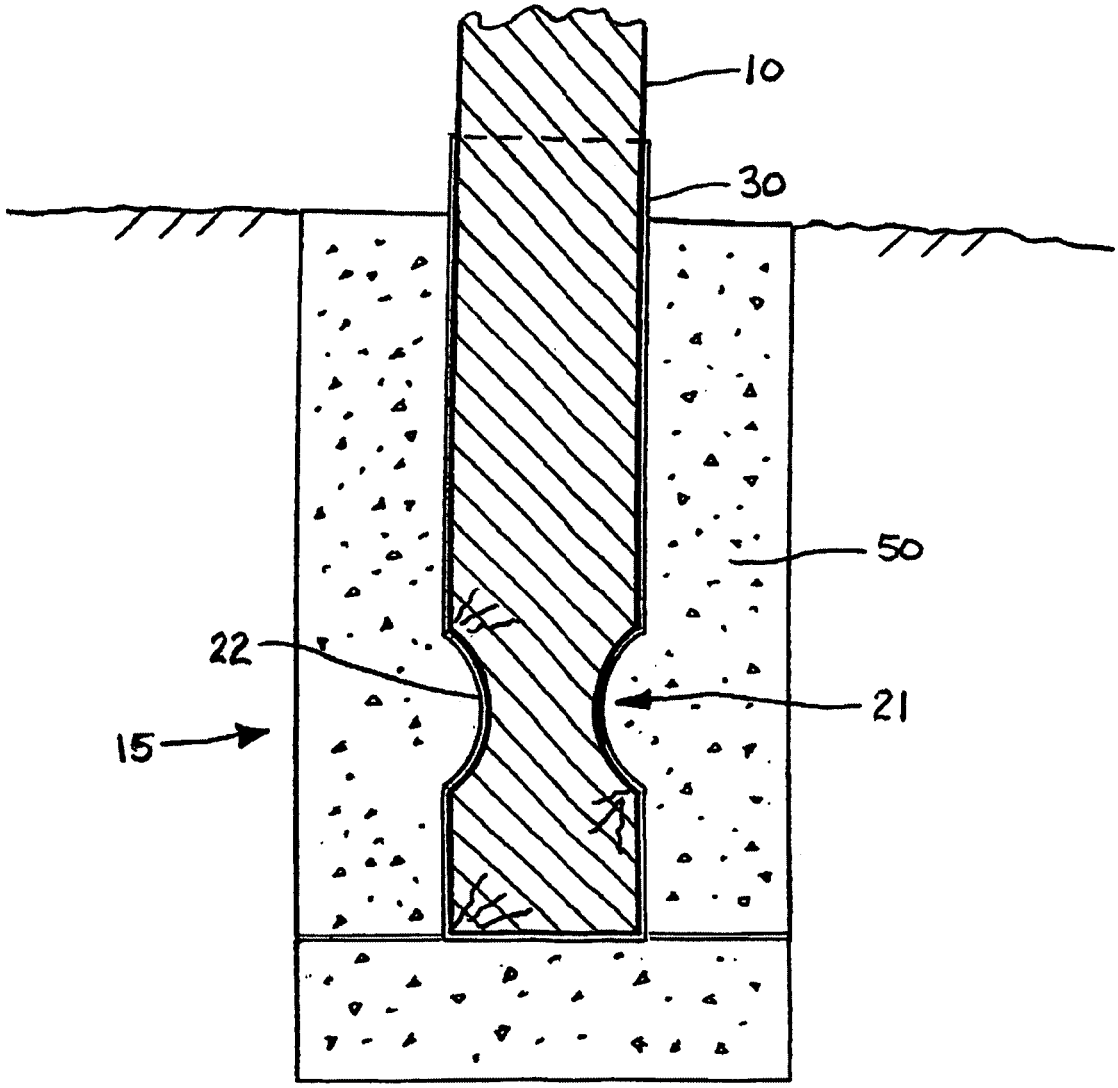
FIG. 2 is a partial elevation view of the preferred embodiment using a typical square wooden post and shows the embedded end of the post and the interaction between the post, the anchoring indentations, and the backfill media.

FIG. 2 is a partial elevation section view of the preferred embodiment of post retention anchor 15. Post 10 is a conventional rectangular wooden post used in post-frame building construction. Post 10 is covered with conforming, protective cover 30, placed in a conventional post hole, and backfilled to retain the post in position. Backfill 50 shown in the figure is concrete. First anchor indentation 21 and second anchor indentation 22 are located on opposing longitudinal corners of the post. The anchor indentations have a rounded shape, as a circular segment in the elevation view. Backfill 50 fills the open space in the post hole, including first and second anchor indentations 21 and 22. Post pull-out resistance depends upon four characteristics of the interaction between post 10 and the earth. These characteristics include material strength of the post, material strength of the backfill media, shear area of the anchor indentations, and soil characteristics. Soil characteristics generally establish the required depth of the hole and the diameter of the hole relative to the size of the post to be inserted. Restraining area of the anchor indentations is varied by varying the number of indentations, indentation size, indentation shape, location of the indentations, or a combination thereof. Indentations are ideally added in pairs on opposing corners of the post. Adjacent pairs are arranged perpendicularly to each other and spaced along the length of the post so that they do not overlap and weaken the post by excessive material removal in the same perimeter plane.

Figure 3A:
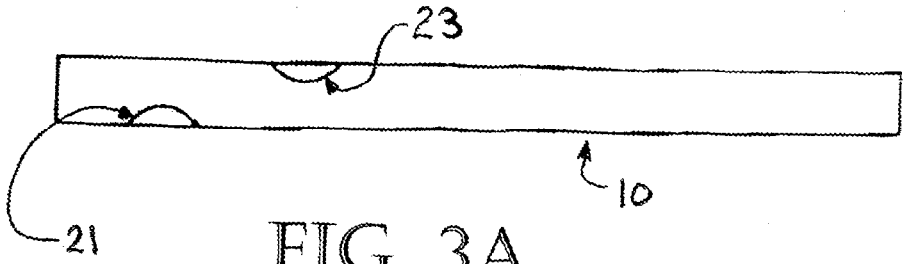
FIGS. 3A, 3B, 3C, and 3D are various partial views of the preferred embodiment using a rectangular post, including limited dimensions.
Figure 3B:
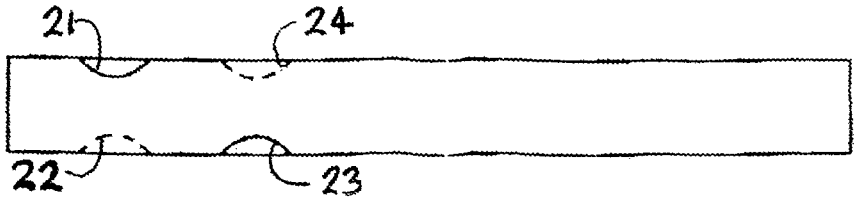
Figure 3C:
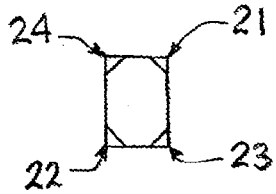
Figure 3D:
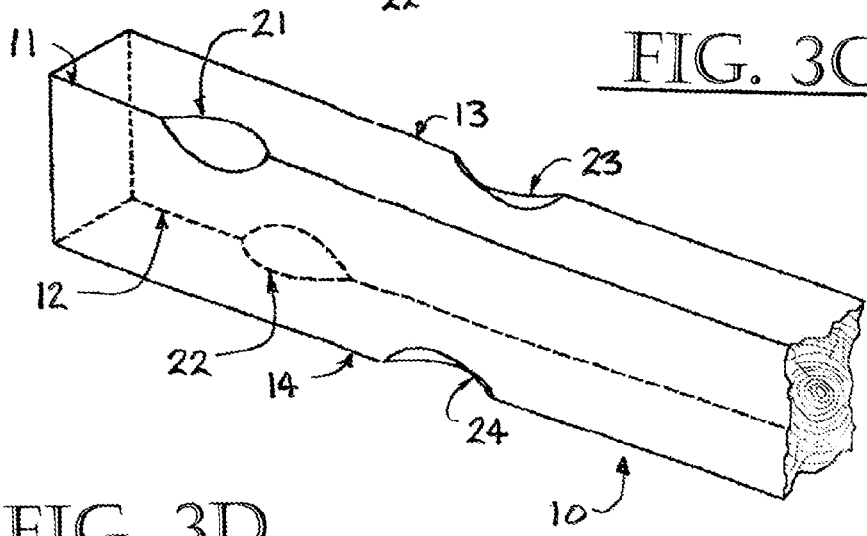

FIGS. 3A, 3B, 3C, and 3D show partial views of the preferred embodiment using a rectangular post and include certain typical dimensions of the anchor indentations and their locations on post 10. First anchor indentation 21 is located on first longitudinal corner 11 approximately four inches from the embedded end of post 10. The anchor indentation length is approximately four inches along first longitudinal corner and intrudes approximately ¾ inches into the post. Second anchor indentation 22 is located on second longitudinal corner 12. Second longitudinal corner 21 is opposite from first longitudinal corner 11. The location of second anchor indentation 22 is ideally symmetric with first anchor indentation 21, but other locations are permissible. FIG. 3D also shows a second pair of anchor indentations. Third anchor indentation 23 and forth anchor indentation 24 are located on third longitudinal corner 13 and fourth longitudinal corner 14, respectively. Third and fourth longitudinal corners are opposite to first and second longitudinal corners, respectively, such that a plane intersecting the third and fourth longitudinal corners is perpendicular to the plane that intersects the first and second longitudinal corners. The effect is that the location of each successive, adjacent pair of indentations is oriented in perpendicular planes about the longitudinal axis of the post, illustrated in FIG. 3C.

Spacing for adjacent pairs of indentations is shown in FIG. 3A. Anchor indentations 21 and 22 are shown separated from anchor indentation 23 and 24 by approximately four inches of unaltered post. The spacing along the post longitudinal axis between successive pairs of indentations may be as little as zero and still allow proper application of the preferred conforming, protective cover. Overlapping indentations, where one indentation is made on each post corner and all four are located the same distance from the post end, potentially weakens the post by excessive material removal in the same perimeter plane, resulting in non-negligible reduction of post cross-sectional area. Additionally, the shrink ratio of some heat-shrinkable materials may be insufficient to allow the conforming, protective cover to fully conform to the post contours. Any resulting void areas between the protective cover and the post would dramatically reduce both the anchoring effectiveness and the protective cover effectiveness. Maximum spacing between adjacent indentation pairs is limited only by the embedded length of the post and the required number of indentations to provide the desired pull-out resistance. Spacing between successive indentation pairs on the same longitudinal corners must also provide adequate shear area between the indentations. Spacing between these pairs should be no less than the spacing between the post end and the first indentation pair.

Figure 4:
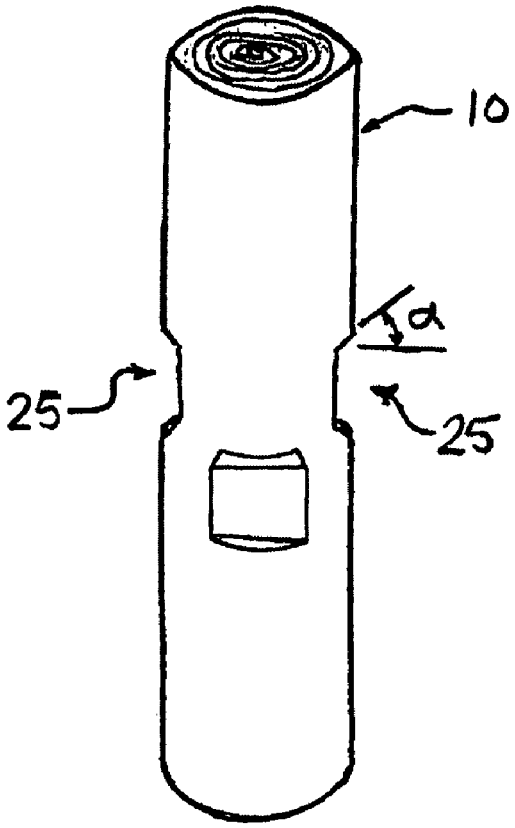
FIG. 4 is a partial perspective view of the embedded portion of a round post with alternate indentations.

FIG. 4 shows the embedded portion of a round post with alternate indentations 25. These indentations have a more angular shape, with the transition into the indentation being angled to provide a more streamlined transition between the post surface and the indentation compared to a squared indentation in which the ends of the indentation are aligned perpendicular to the longitudinal post axis. The indentation transition arrangement is shown in FIG. 4 as angle $\alpha$, wherein angle $\alpha$ is greater than 0 degrees. Angle $\alpha$ in a squared indentation is equal to 0 degrees. Arrangement of additional indentations and/or indentation pairs is as previously described. Selecting the transition shape depends upon the type of conforming, protective cover to be applied. For example, a paint-like coating applied as a protective cover for the post could easily conform to almost any indentation configuration. Protective covers based on shrinkable plastic materials require smoother transitions between the post and the indentation. Indentation shape, orientation, and arrangement on the post must also be considered when designing post anchors for use with shrinkable plastic protective covers.

Figure 5:
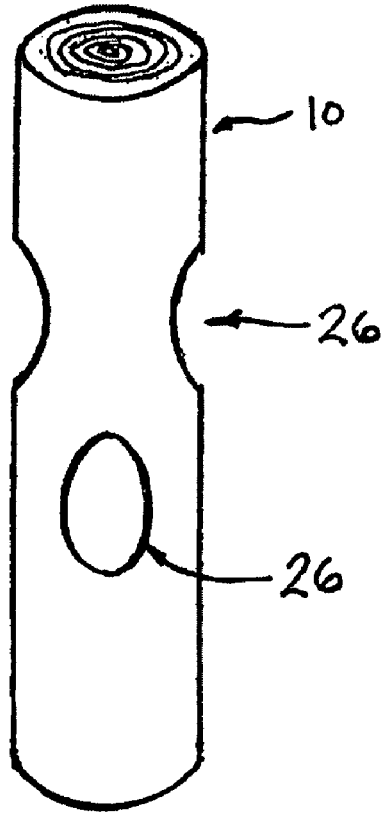
FIG. 5 is a partial perspective view of the embedded portion of a round post with the preferred embodiment indentations.

FIG. 5 shows the embedded portion of a round post with anchor indentations 26 in the preferred embodiment. Rounded indentations provide optimal transition between the post surface and the indentation for use with conforming, protective coatings that use rely on shrinkable materials. While FIG. 5 shows post 10 as wooden, this figure also illustrates the invention when applied to a hollow, metallic post or pipe. Indentations on hollow pipe are more likely to pressed or stamped into the exterior surface instead of cut, since cutting an indentation into a hollow post would open a hole into the post without forming the desired anchoring restraining surface area.

Figure 6:
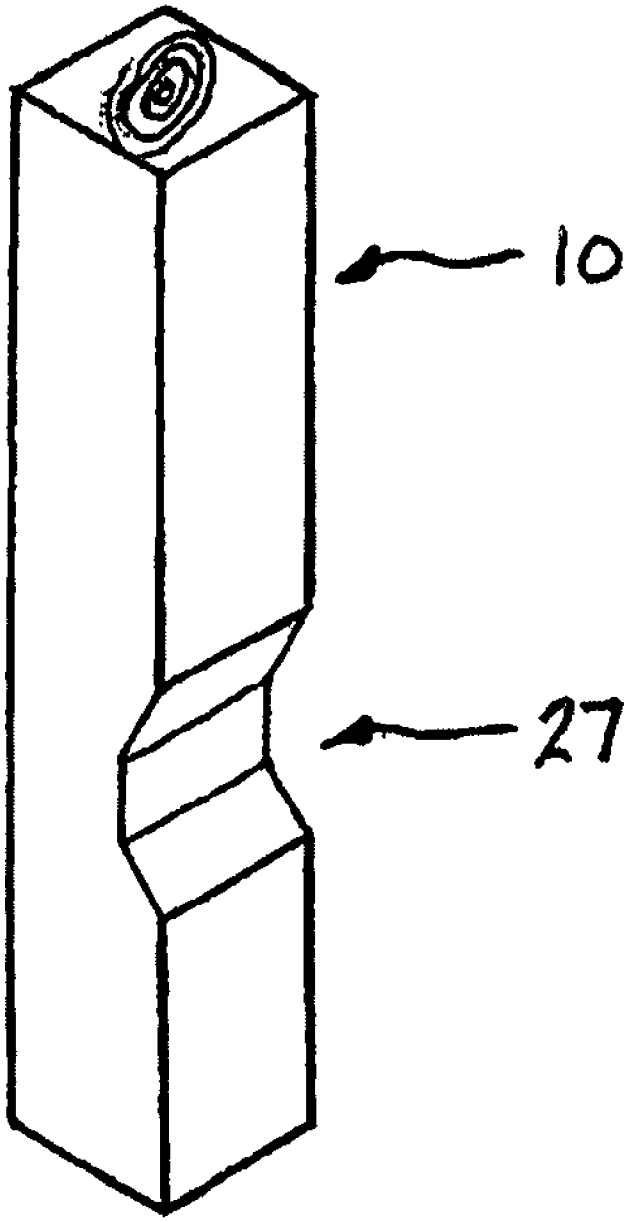
FIG. 6 is a partial perspective view of the embedded portion of a rectangular post with an alternate indentation.

FIG. 6 shows partial perspective view of the embedded portion of a rectangular post with an alternate indentation 27. In this embodiment, the indentation is located on a face of the post instead of a longitudinal corner and features angled transitions instead of the preferred rounded transitions.

Although the invention has been described in connection with specific examples and embodiments, those skilled in the art will recognize that the present invention is capable of other variations and modifications within the scope of the invention but beyond those described herein. These examples and embodiments are intended as typical of, rather than in any way limiting on, the scope of the present invention as presented in the following claims.

We claim as new and for which a Letters Patent of the United States is desired to be secured is:

1. An elongate wooden post for embedment in the ground comprising:

a first portion for embedment into the ground, said first portion having a longitudinal axis and a solid cross-sectional shape having a first cross-sectional area oriented perpendicular to said longitudinal axis;

a second portion integrally formed with and extending from said first portion for extending along said longitudinal axis upwardly above the ground;

at least one notch cut into said first at a predetermined location portion, said at least one notch comprising a predetermined concave arcuate shape extending radially inward a predetermined radial depth into said first portion to define a minimum cross-sectional area of said area of first portion, said minimum cross-sectional area being oriented perpendicular to said longitudinal axis and substantially smaller than said first cross-sectional area, interaction between said at least one notch and the ground creating a compressive interaction, variation in said predetermined radial depth enabling a post pull-out force to be selectively increased to a desired value resulting from increasing the compressive force interaction between said at least one notch and the ground wherein said desired value exceeds a pull-out force resulting from a shear force interaction between the post and the ground; and a protective cover formed from a non-perforated plastic heat-shrunk material covering the entirety of said first portion and an adjacent portion of said second portion to prevent deterioration of said wooden post, said material having a shrink ratio wherein said shrink ratio is equal to or greater than a ratio of said first cross-sectional area to said minimum cross-sectional area thereby enabling said cover to fully conform to the surface of said post and said at least one notch.

2. The post of claim 1, wherein said post has a generally rectangular cross section and said at least one notch is formed on an apex of two adjacent sides of said post.

* * * * *

UNITED STATES PATENT AND TRADEMARK OFFICE

CERTIFICATE OF CORRECTION

PATENT NO. : 7,506,859 B2
APPLICATION NO. : 11/251036
DATED : March 24, 2009
INVENTOR(S) : William R. Keller et al.

It is certified that error appears in the above-identified patent and that said Letters Patent is hereby corrected as shown below:

Column 7, lines 26 - 27 should read, "at least one notch cut into said first portion at a predetermined location, said at least one notch comprising a".

Column 8, lines 1 - 3 should read, "inward a predetermined radial depth into said first portion to define a minimum cross-sectional area of said first portion, said minimum cross-sectional area".

Signed and Sealed this

Twenty-third Day of November, 2010

David J. Kappos

David J. Kappos
*Director of the United States Patent and Trademark Office*